US006487275B1

(12) United States Patent
Baba et al.

(10) Patent No.: US 6,487,275 B1
(45) Date of Patent: Nov. 26, 2002

(54) ANODE TARGET FOR X-RAY TUBE AND X-RAY TUBE THEREWITH

(75) Inventors: Noboru Baba, Hitachioota (JP); Masao Shimizu, Mito (JP); Motomichi Doi, Kashiwa (JP); Yuzo Kozono, Hitachioota (JP); Kunihiro Maeda, Hitachi (JP); Masatoshi Seki, Hitachinaka (JP)

(73) Assignees: Hitachi, Ltd., Tokyo (JP); Hitachi Medical Corporation, Tokyo (JP)

( * ) Notice: Subject to any disclaimer, the term of this patent is extended or adjusted under 35 U.S.C. 154(b) by 0 days.

(21) Appl. No.: 08/718,412

(22) PCT Filed: Mar. 27, 1995

(86) PCT No.: PCT/JP95/00556

§ 371 (c)(1),
(2), (4) Date: Feb. 12, 1998

(87) PCT Pub. No.: WO95/26565

PCT Pub. Date: Oct. 5, 1995

(30) Foreign Application Priority Data

Mar. 28, 1994 (JP) ..... 6-056936

(51) Int. Cl.[7] ..... H01J 35/10
(52) U.S. Cl. ..... 378/144; 378/143
(58) Field of Search ..... 378/119, 125, 378/143, 144

(56) References Cited

U.S. PATENT DOCUMENTS

| | | | | |
|---|---|---|---|---|
| 2,521,663 A | | 9/1950 | Zunick et al. | |
| 2,863,083 A | | 12/1958 | Schram et al. | |
| 3,375,109 A | | 3/1968 | Peters et al. | |
| 3,790,838 A | | 2/1974 | Baum | |
| 4,920,012 A | | 4/1990 | Woodruff et al. | |
| 4,939,762 A | * | 7/1990 | Baba et al. | 378/144 |
| 5,204,891 A | | 4/1993 | Woodruff et al. | |
| 5,352,489 A | * | 10/1994 | Ohara et al. | 427/250 |
| 5,508,118 A | * | 4/1996 | Hayashi et al. | 378/144 |

FOREIGN PATENT DOCUMENTS

| | | |
|---|---|---|
| EP | 0 305 547 A1 | 3/1989 |
| EP | 0 513 830 A1 | 11/1992 |
| EP | 0 578 109 A1 | 1/1994 |
| GB | 1173859 | 12/1969 |
| JP | 54-34517 | 10/1979 |
| JP | 57-176654 | 10/1982 |
| JP | 63-146330 | 6/1988 |
| JP | 63-193442 | 8/1988 |
| JP | 1-107439 | 4/1989 |
| JP | 3-82765 | 4/1991 |
| JP | 5-279710 | 10/1993 |

* cited by examiner

*Primary Examiner*—David P. Porta
(74) *Attorney, Agent, or Firm*—Antonelli, Terry, Stout & Kraus, LLP

(57) ABSTRACT

An X-ray tube which is high in brightness and high in resolution, and can withstand continuous long-time use, that is, it can withstand a high heat load. An X-ray target and an X-ray tube having the X-ray target include an X-ray generating metal layer having an average crystal grain diameter not larger than 30 $\mu$m on the surface of a base plate in the X-ray irradiated side. The X-ray tube has a small focus point and can withstand a high input load. A CT apparatus using the X-ray tube can provide a high resolution and a high definition image.

18 Claims, 10 Drawing Sheets

| X-RAY GENERATING METAL LAYER | GRAIN DIAMETER | SURFACE ROUGHNESS |
|---|---|---|
|  | SMALL | SMALL |
|  | LARGE | LARGE |

(a)

(b)

(a)

(b)

ANODE TARGET FOR X-RAY TUBE AND X-RAY TUBE THEREWITH

TECHNICAL FIELD

The present invention relates to an X-ray tube generating an X-ray by irradiating an electron beam, an anode of an X-ray target of an X-ray tube and an X-ray apparatus using the X-ray tube and, more particularly, to a medical X-ray tube and a medical X-ray apparatus which is required to be high in load resistivity and high in brightness and definition of an image.

BACKGROUND ART

In an X-ray generating apparatus for industrial use or medical use, an X-ray is generated by irradiating thermal electrons emitted from an cathode onto an anode target. An X-ray generating metal for the anode target (hereinafter, referred to as "X-ray target") used is tungsten (W) or a tungsten alloy which has a high X-ray generating efficiency and a high melting point.

An X-ray tube for medical use is required to produce a high definition image of a medical examination portion and to have a higher X-ray output compared to a common X-ray tube. Since most part of energy of an electron beam is converted into heat when an X-ray is generated, the X-ray target is heated to high temperature.

Further, a high power X-ray tube is so constructed that the X-ray target is rotated during electron beam irradiation in order to prevent the X-ray target from overheating. Therefore, the X-ray tube is required to have a high heat resistance and a high strength during rotation. A method for coping with this problem is disclosed, for example, in Japanese Patent Application Laid-Open No.58-59545. In the method, a tungsten or tungsten alloy layer is formed onto the surface of a molybdenum or molybdenum alloy base plate through a chemical deposition method or the like. This method has an advantage in better bonding ability between the surface of the molybdenum alloy base plate and the tungsten alloy layer and accordingly in a high thermal conductivity. A method of manufacturing an X-ray target is also disclosed in Japanese Patent Application Laid-Open No. 57-176654. In the method, a tungsten or tungsten alloy layer is successively laminated onto the surface of a molybdenum or molybdenum alloy base plate through a chemical deposition method or the like, and then the laminated X-ray target is annealed to improve the adhesive force. The X-ray tubes using such X-ray targets have a better load resistivity compared to an X-ray tube having a conventional X-ray generating metal, and can withstand a longtime and continuous use.

As the progress of an X-ray apparatus with computer processing such as a X-ray CT apparatus for medical use, an X-ray tube is required to cope with a high resolution processed image. Further, it is required that the X-ray tube can withstand a long-time and continuous use. In order to do so, it is necessary to increase input power to the X-ray tube to increase the amount of X-ray radiation. In addition to this, in order to obtain a high resolution image, it is important to converge an electron beam from a cathode small, that is, to increase the brightness by small focusing and large current density. Therefore, it is required that the X-ray target can withstand a large heat load on the electron irradiation surface. To these requirements, the method of Japanese Patent Application Laid-Open No.58-59545 has a problem in that the surface of the X-ray generating metal made of a tungsten alloy is roughed and the X-ray generating efficiency is decreased as it is used long time.

On the other hand, the method of Japanese Patent Application Laid-Open No.57-176654 has a disadvantage in that the process of manufacturing the target is complex and accordingly its manufacturing cost may be increased.

DISCLOSURE OF INVENTION

An object of the present invention is to provide an X-ray tube which is high in brightness and high in resolution, and can withstand continuous long-time use, that is, can withstand a high heat load, and to provide an X-ray apparatus such as an X-ray CT apparatus capable of obtaining a more clear image using the X-ray tube.

The object of the present invention can be attained by providing an X-ray tube generating an X-ray from a metal surface by irradiating an electron beam, wherein at least a part of an electron irradiating surface of an anode target of the X-ray tube comprises an X-ray generating metal having an average crystal grain diameter not larger than 30 $\mu$m, preferably not larger than 10 $\mu$m, on the surface of a base plate made of a metal. The "average crystal diameter" here means a minor axis when the crystal grain is flat. The crystal grain diameter may be obtained by taking a picture of a polished surface using an optical microscope or an electron microscope, and calculating through an image processing method or measuring crystallographically using an X-ray. In these cases, although the crystal grain diameter is apt to be measured smaller in a case of using the X-ray, it is sufficient that the measured average crystal grain diameter is within the above range whichever method is chosen.

It is preferable that the X-ray generating metal having an average crystal grain diameter not larger than 30 $\mu$m is composed of two or more layers. The "two or more layers" means that the composition of each layer may be different, or a boundary may be simply formed between layers. For example, in a case of forming an X-ray generating metal layer through the chemical vapor deposition method, by stopping to supply the process gas for a while during forming a layer and then starting to supply the process gas, a boundary is formed and two layers can be observed. In film forming through chemical vapor deposition, seed crystals are firstly formed on a base plate and then crystals grow based on the seed crystals to form a film. When supply of the process gas is stopped for a while, crystal growth is stopped at that time. When supply of the process gas is started again, seed crystals are newly formed. In such a way, two or more layers of metal films can be formed even if the composition of each of the layers is the same. The most convenient way to judge whether two or more layers are formed is to polish a cross section of the X-ray target and observe it by a microscope.

Further, it is preferable that, in the X-ray tube, the X-ray generating metal having an average crystal grain diameter not larger than 30 $\mu$m is composed of two or more layers containing tungsten and rhenium, and tungsten concentration in the layer in contact with the metal base plate is higher than tungsten concentration in the surface layer of the electron irradiating surface. A preferable X-ray generating metal is a substance having a larger atomic number which has a higher X-ray generating efficiency, but it is required to have a higher melting point. Although tungsten is generally used as an element to satisfy these requirements, rhenium is added as an alloy element since tungsten itself is low in high temperature strength and accordingly is unsuitable for practical use.

It is also preferable that the thickness of the X-ray generating metal layer is not larger than 200 μm.

It is preferable that the X-ray generating metal layer described above has a tungsten alloy layer in the side of the base plate.

Further, the present invention provides an X-ray tube in which at least a part of an electron irradiating surface of an anode target of the X-ray tube comprises two or more layers of alloy layers on the surface of a metal base plate. The definition of "two or more layers" is the same as described above.

Furthermore, the present invention provides an X-ray tube generating an X-ray from a metal surface by irradiating an electron beam in which at least a part of an electron irradiating surface of an anode target of the X-ray tube comprises an X-ray generating layer having a columnar crystal structure on the surface of a metal base plate. The "columnar crystal structure" hear means a crystal structure in which directions of crystals (directions of longitudinal axis of the crystals) are oriented in nearly the same direction and the aspect ratio of the crystal is approximately more than 5.

Further, the present invention provides an X-ray tube generating an X-ray from a metal surface by irradiating an electron beam, in which at least a part of an electron irradiating surface of an anode target of the X-ray tube comprises an X-ray generating layer made of tungsten and rhenium on the surface of a metal base plate, and concentration of elements except for the tungsten and the rhenium in the X-ray generating metal is not larger than 100 ppm. The concentration is indicated by unit of weight ratio and analyzed through a method such as chemical analysis, instrumental analysis or the like.

It is preferable that the metal layer containing tungsten and rhenium having maximum thickness of not larger than 100 μm is formed at least on a part of a base plate made of a metallic sintered material having molybdenum as the main component in the side of electron irradiating surface. There is no need that the X-ray generating metal layer covers the whole surface of the electron irradiating surface of the metal base plate, but the X-ray generating metal layer may exist in, for example, a radial shape. It is preferable that a metal layer containing tungsten and rhenium having an average crystal grain diameter not smaller than 30 μm is formed at least on a part of a base plate made of a metallic sintered material having molybdenum as the main component in the side of electron irradiating surface, and the metal layer having average crystal grain diameter not larger than 10 μm is formed at least on a part of the metal surface having an average crystal grain diameter not smaller than 30 μm in the side of electron irradiating surface. It is preferable that a clear boundary exists between the metal surface having an average crystal grain diameter not smaller than 30 μm and the metal layer having average crystal grain diameter not larger than 10 μm.

Further, it is preferable that the metal layer containing tungsten and rhenium is formed at least on a part of a base plate made of a metallic sintered material having molybdenum as the main component in the side of electron irradiating surface, and distribution of rhenium in the metal layer is uniform. When a cross section of an X-ray generating metal of a sintered material sintered formed by adding rhenium powder is observed by a scanning electron microscope and analyzed by an electron probe micro-analyzer, it is found that rhenium particles as it is exist in the sintered material and accordingly there is deviation in rhenium distribution. In a case of forming the metal film through a method such as chemical vapor deposition method, physical vapor deposition method, sputtering method or the like, such variation does not exist and rhenium is uniformly dispersed in the tungsten.

It is preferable that the metal layer containing tungsten and rhenium is formed at least on a part of a base plate made of a metallic sintered substance having molybdenum as the main component in the side of electron irradiating surface, and relative density to the theoretical density of the metal layer is not smaller than 98%. A value described in a chemical handbook or the like is used as the theoretical density. The density may be measured through a hydraulic replacing method (Archimedes' method) or the like. The most convenient way to measure the density of the X-ray generating metal of metal thin film is to mechanically peel off the film from the base plate.

It is preferable that the composition ratio of rhenium to tungsten of the metal layer containing tungsten and rhenium is larger in the electron irradiated side of said layer. The efficiency of generating X-ray is larger in a metal having a larger atomic number. The atomic number of tungsten is 74 and the atomic number of rhenium is 75. Therefore, the efficiency of generating X-ray is larger in rhenium than in tungsten. On the other hand, the penetrating depth of electron into the X-ray generating metal surface is approximately 10 μm, but it depends on the energy of electron. Therefore, it is preferable that the content of rhenium is made large in the zone up to the depth of 10 μm from the surface and the content of tungsten is increased as the depth approaches to the metal base plate. The melting point of rhenium is lower compared to that of tungsten, and the price of rhenium is higher compared to that of tungsten. In regard to surface melt and cost, it is not preferable to make the content of rhenium excessively high.

FIG. 1 is a view showing a simulation result of temperature distribution in an X-ray target of an X-ray tube during using. Temperature at the surface of the electron irradiating surface is increased up to approximately 1500° C., but temperature at a position beneath the surface is steeply decreased. In a case where graphite is used as the base plate and an X-ray generating metal layer is formed on the electron irradiating surface though chemical vapor deposition method, temperature at the boundary between the graphite base plate and the X-ray generating metal layer is increased above 1300° C. since the X-ray generating metal layer is formed so as to have a thickness less than 500 μm due to manufacturing cost. In such a temperature condition, the graphite reacts with the tungsten in the X-ray generating metal layer made of a tungsten-rhenium alloy to form a carbide such as tungsten carbide. When such a carbide is formed, the bonding force in the boundary is decreased, and cracks and delamination possibly occur at the junction portion during using the X-ray tube.

Since such a carbide has a small thermal conductivity, the heat generated on the electron irradiating surface is not sufficiently dispersed. That is, the temperature of the electron irradiating surface is increased and the load resistivity is decreased.

The inventors of the present invention invented the present invention by studying an X-ray target which did not decrease its load resistivity due to formation of such a carbide. That is, the inventors of the present invention found that an X-ray target having a high load resistivity could be obtained by making the base plate of the X-ray target with a metal sintered material such as molybdenum and forming an X-ray generating metal film having average grain diameter smaller than 30 μm on the base plate using a thin film technology such as a chemical vapor deposition method.

There is a phenomenon that the surface shape of the X-ray generating metal is roughened when an X-ray tube is used for long time. This phenomenon is caused by sublimation or melting of the X-ray generating metal because the temperature near the electron irradiating surface increases up to approximately 2000° C. When the surface is roughened, the X-ray generating amount is decreased because X-ray emitted from the surface of the X-ray generating surface is scattered by the rough surface. FIG. 2 is a schematic view showing this phenomenon.

The inventors found that small crystal grain diameter was effective to suppress this phenomenon. The reason is that sublimation and melting of the X-ray generating surface occur in the grain boundaries first. FIG. 3 is a schematic view showing this phenomenon.

From these facts, the inventors found that an X-ray tube had a high brightness and a small degradation in performance when it was used for a long time. The X-ray tube comprised an X-ray target of an X-ray generating metal layer having average grain diameter not larger than 30 μm, preferably not larger than 10 μm, formed through chemical vapor deposition method or the like.

FIG. 4 is a graph showing the relationship between crystal grain diameter and surface roughness of an X-ray generating metal layer. In order to accelerate testing time, this test was performed by irradiating YAG laser instead of electron beam to supply a high heat input and measuring worn amount of the X-ray generating metal surface. It can be understood from the result that the X-ray target having a crystal grain diameter smaller than 10 μm is smaller in worn cross sectional area and smaller in surface roughness than the X-ray target having a crystal grain diameter of nearly 50 μm. The reference character Z in FIG. 4 indicates the distance between the center of a laser focus lens and a sample surface. FIG. 5 is photographs showing cross-sectional features. The photograph in FIG. 5(*a*) shows a cross-sectional feature of the chemical vapor deposited tungsten-rhenium layer (20 go-and-return cycles), and the photograph in FIG. 5(*b*) shows a cross-sectional feature of the sintered tungsten-rhenium layer (20 -go-and-return cycles). The length of 1 cm in FIG. 5 corresponds to 20 μm.

FIG. 6 is a graph showing dependence of crystal grain diameter in X-ray generating metal on heating temperature. It can be understood that the crystal grain diameter of an X-ray generating metal layer having initial grain diameter of nearly 1 μm is grown not so large after heating at 2000° C. for 1 hour. This means that the crystal grain diameter of the X-ray generating metal layer does not coarsen with time and accordingly there is little problem in surface roughing.

An X-ray target shown in FIG. 7 was manufactured. The X-ray target was manufactured by forming a tungsten-rhenium sintered alloy having thickness of approximately 10 μm on the surface of a molybdenum sintered alloy base plate to manufacture a base X-ray target, and by further forming an X-ray generating metal layer having crystal grain diameter smaller than 10 μm and thickness of 100 μm on the half surface of the base X-ray target. The X-ray target was irradiated with an electron beam for a predetermined cycles while the X-ray target was being rotated, and then rotation of the target was stopped. FIG. 8 is a graph showing the measured result of amount of generated X-ray and reducing ratio of X-ray generation for the side with the X-ray generating metal layer and the side without the X-ray generating metal layer. The amount of generated X-ray is more in the side with the X-ray generating metal layer by nearly 10% than in the side without the X-ray generating metal layer. The reducing ratio of generated X-ray is less in the side with the X-ray generating metal layer by nearly 5% than in the side without the X-ray generating metal layer. FIG. 9 is photographs showing cross-sectional structures near the X-lay generating metal layers after the test. The photograph in FIG. 9(*a*) shows a cross-sectional feature of the chemical vapor deposited tungsten-rhenium layer, and the photograph in FIG. 9(*b*) shows a cross-sectional feature of the sintered tungsten-rhenium layer. The length of 1 cm in FIG. 9 corresponds to 100 μm. The surface roughness is smaller in the side with the X-ray generating metal layer than in the side without the X-ray generating metal layer. Measurement by a probe type surface roughness meter showed that the average roughness (Ra) and the maximum roughness (Rmax) in the side with the X-ray generating metal layer were 5.7 μm and 45 μm, and on the other hand the average roughness (Ra) and the maximum roughness (Rmax) in the side without the X-ray generating metal layer were 7.5 μm and 71 μm. That is, the surface roughness was smaller in the side with the X-ray generating metal layer than in the side without the X-ray generating metal layer.

After studying the differences in the test results of the X-ray target with the X-ray generating metal layer and the X-ray target without the X-ray generating metal layer, the following results are obtained.

(1) When the crystal grain diameter of the electron irradiating surface is smaller than a certain value, the surface roughness is small.

(2) When there is a boundary between the surface layer and the base plate, a crack starting from a point on the surface is suppressed to progress and the crack progress distance is shortened.

(3) It is revealed from an analysis using an electron probe micro-analyzer that rhenium distribution in the X-ray generating metal layer formed on the surface is uniform compared to that in the sintered tungsten-rhenium layer.

(4) The relative density to the theoretical density is large in the surface of the X-ray generating metal layer than in the surface of the sintered tungsten-rhenium layer. That is, the sintered tungsten-rhenium layer has a lot of voids and the surface roughness is large.

Based on the above test data, the requirements for an X-ray tube having high brightness and long life-time are obtained as follows.

(1) An X-ray generating metal layer having a maximum drain diameter not larger than 30 μm, preferably a maximum grain diameter not larger than 10 μm, is formed on the surface of a metal base plate made of molybdenum or the like.

(2) A boundary exists between the X-ray generating metal layer and the metal base plate or inside the X-ray generating metal layer to prevent progress of a crack.

(3) Rhenium distribution in the X-ray generating metal layer is uniform.

(4) Relative density to the theoretical density in the X-ray generating metal layer is not smaller than 98%.

With the above specified construction, an X-ray tube having high brightness and long life-time can be obtained.

A method of manufacturing an X-ray generating metal layer in accordance with the present invention is characterized by that a tungsten-rhenium film of the X-ray generating metal is formed by using metal halide gases ($WF_6$, $ReF_6$)

containing hydrogen and maintaining the base plate temperature within the range of 200 to 600° C., preferably 400 to 500° C., in which the film forming speed is high and a uniform fine structure can be obtained. When the base plate temperature is lower than 200° C., the film is apt to become non-uniform. On the other hand, when the base plate temperature is higher than 600° C., the fine structure is hardly obtained because content of rhenium becomes low. In order to make the film forming speed high, it is preferable that the chemical vapor deposition pressure is set to near atmospheric pressure. Further, it is also preferable that an amount of rhenium contained in the fine structure tungsten-rhenium alloy is in the range of 2.5 to 26 wt % in order to form the fine structure.

As for a method of manufacturing an X-ray target in accordance with the present invention, it is preferable that a fine structure tungsten-rhenium alloy as an x-ray generating metal material is coated onto a heat resistant anode base plate made of molybdenum or a molybdenum alloy, or tungsten or a tungsten alloy, or a complex base plate formed by laminating layers made of the materials, and then the coated X-ray target is performed with heat-treating at a temperature of 1000 to 2000° C. in a vacuum environment. By the vacuum heat treatment, diffusion between the metal base plate and the X-ray generating metal coated onto the metal base plate is progressed, and at the same time gas contained in the X-ray target is completely removed. When the heating temperature is lower than 1000° C., diffusion between the coated X-ray generating metal and the base plate made of molybdenum or the molybdenum alloy, or tungsten or the tungsten alloy, or the complex base plate formed by laminating layers made of the materials is insufficient and accordingly the coated X-ray generating metal cannot closely attached to the base plate or the complex base plate. Further, the degassing of the X-ray target is insufficient and accordingly the withstanding voltage is lowered due to gas released when the X-ray target is assembled in an X-ray tube. Therefore, an X-ray having a sufficient strength cannot be generated.

BEST MODE FOR CARRYING OUT THE INVENTION (Embodiment 1)

Figure 1:
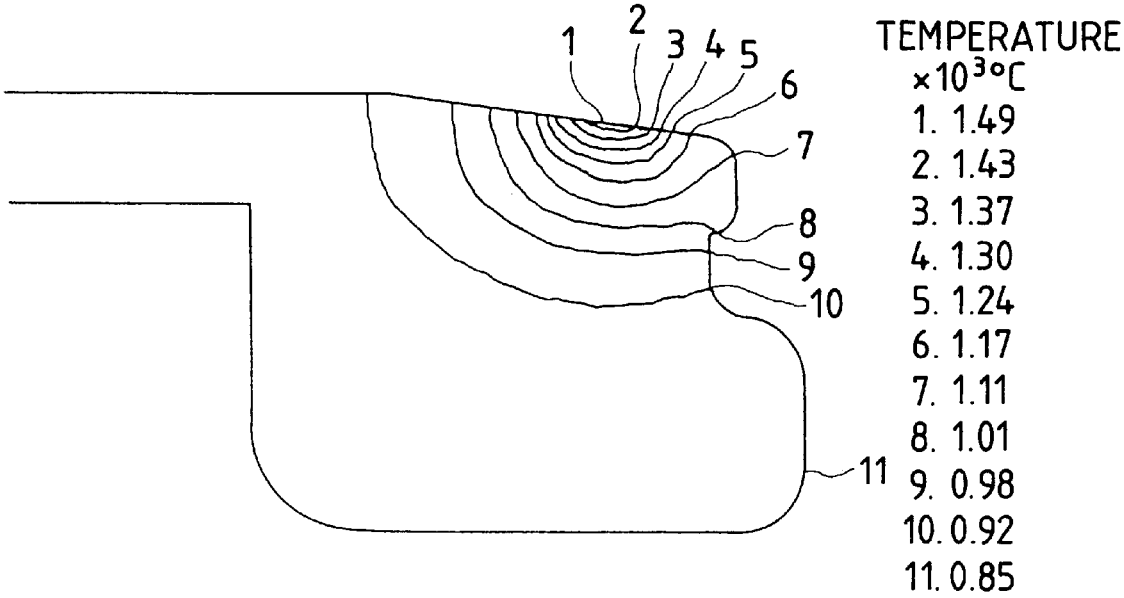
FIG. 1 is a view showing a simulation result of temperature distribution in an X-ray target.
Figure 2:
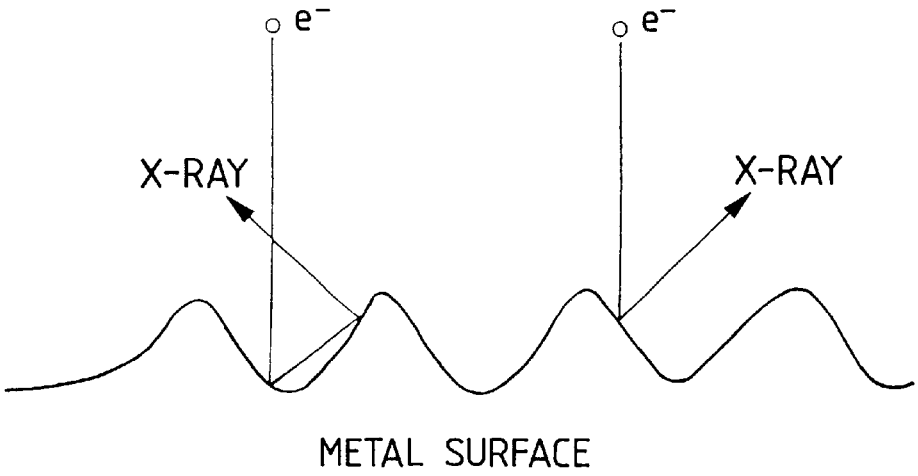
FIG. 2 is a schematic view showing X-ray scattering on the surface of an X-ray target.
Figure 3:
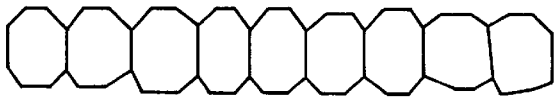
FIG. 3 is a schematic view showing crystal grain diameters and roughnesses of X-ray generating metal surfaces.
Figure 3:
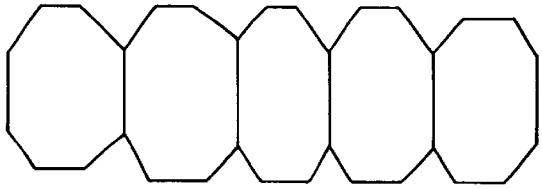
Figure 4:
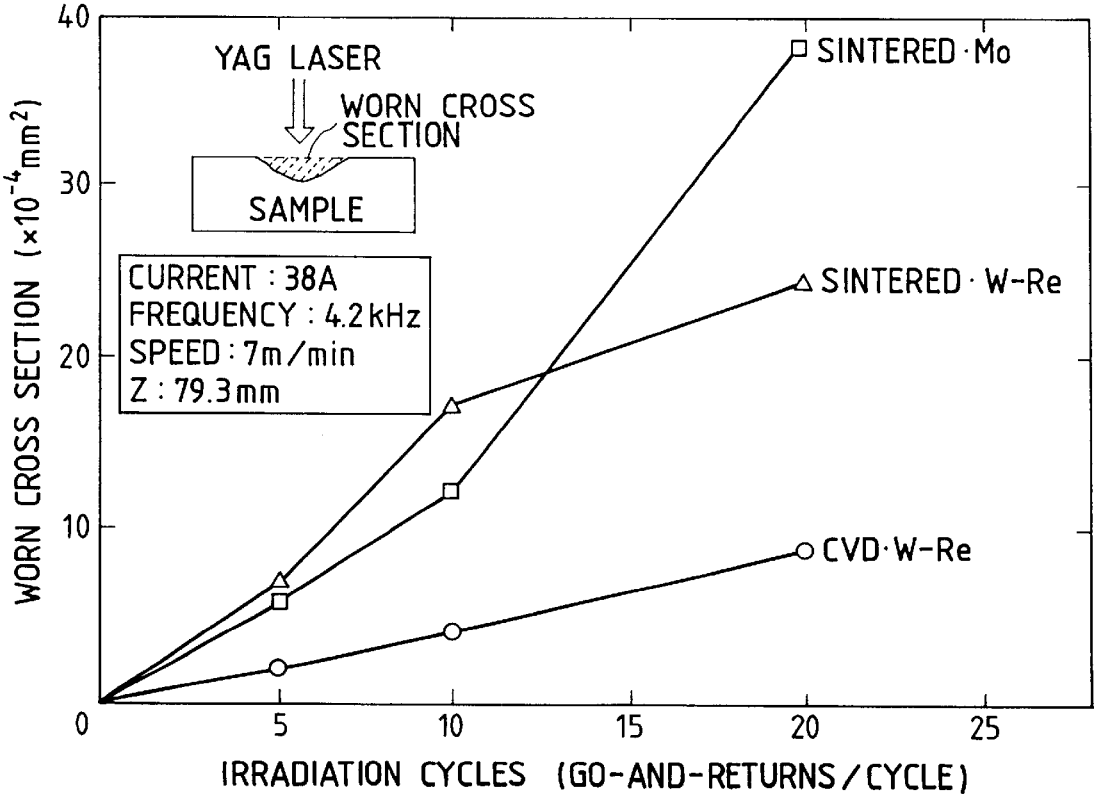
FIG. 4 is a graph showing results of laser acceleration test of X-ray generating metals.
Figure 5:
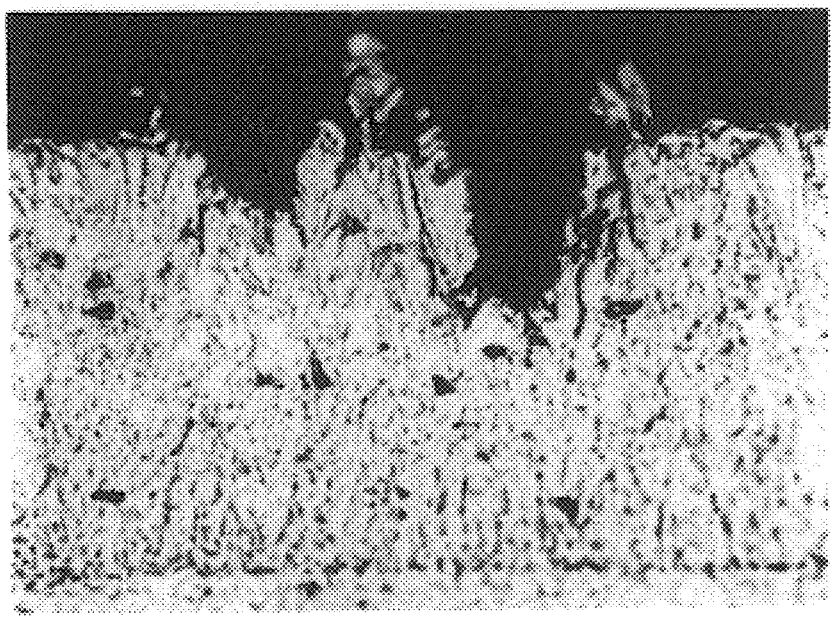
FIG. 5 is photographs showing cross-sectional features after the laser acceleration test.
Figure 5:
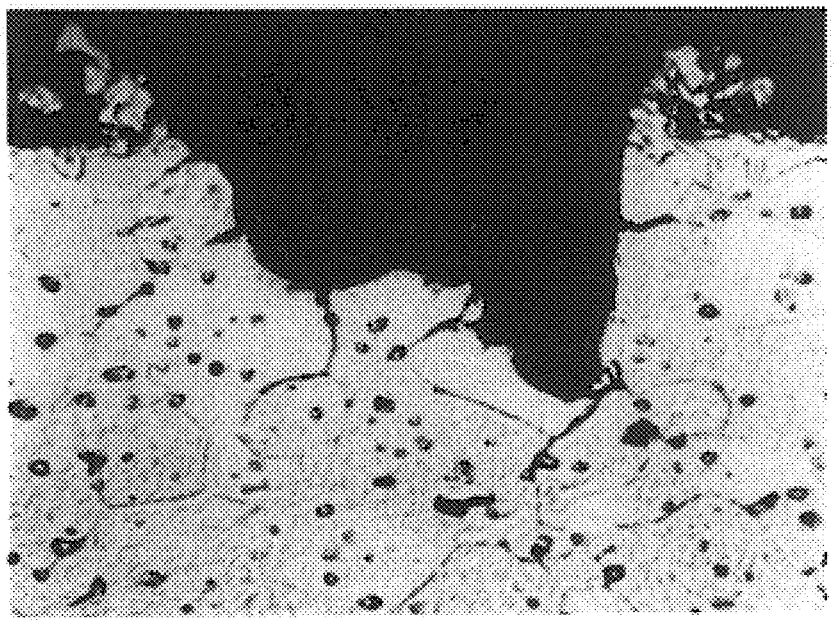
Figure 6:
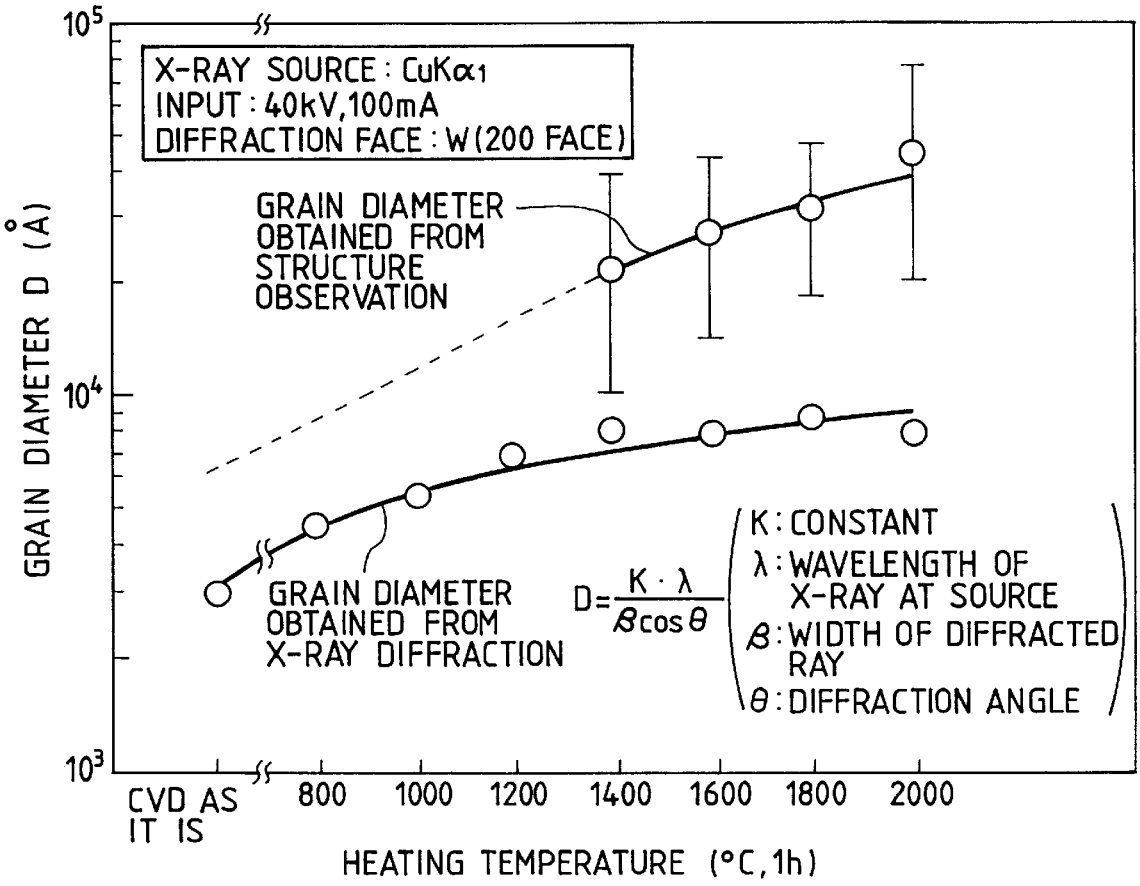
FIG. 6 is a graph showing the relationship between heating temperature and crystal grain diameter in X-ray generating metal of an X-ray target in accordance with the present invention.
Figure 7:
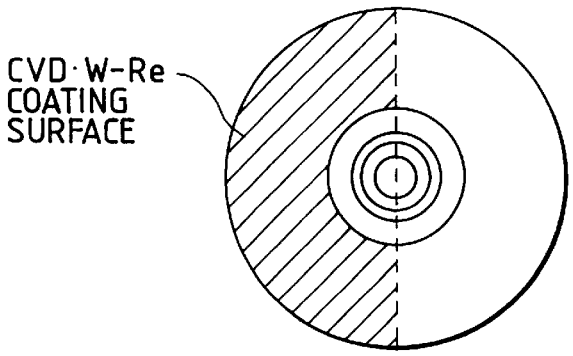
FIG. 7 is a view showing an X-ray target of which half-circle surface is covered with an X-ray generating metal in accordance with the present invention.
Figure 8:
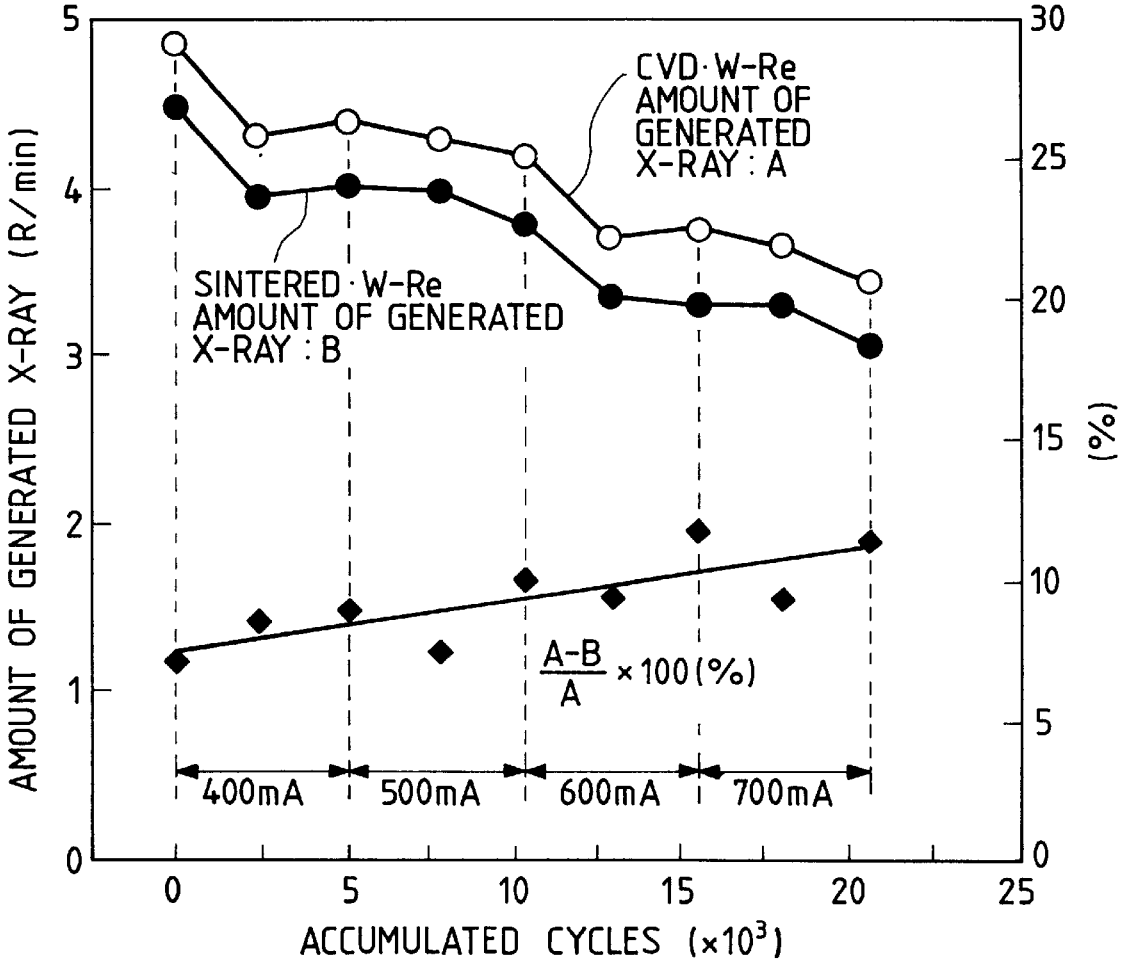
FIG. 8 is a graph showing reducing ratio of X-ray generation and amount of X-ray generation of X-ray targets after an actual load test.
Figure 9:
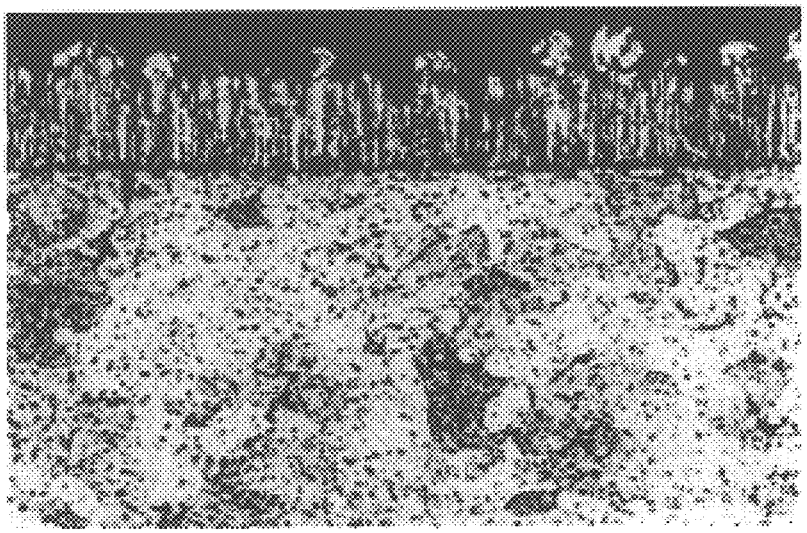
FIG. 9 is photographs showing cross-sectional structures after an actual load test.
Figure 9:
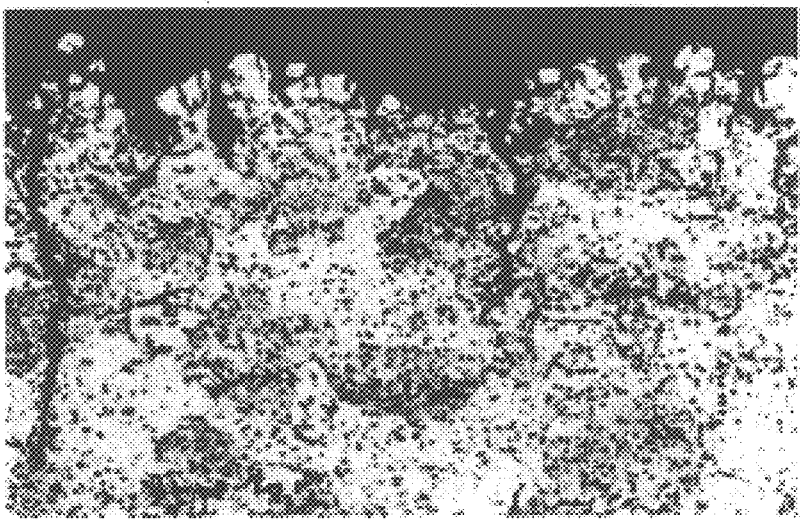
Figure 10:
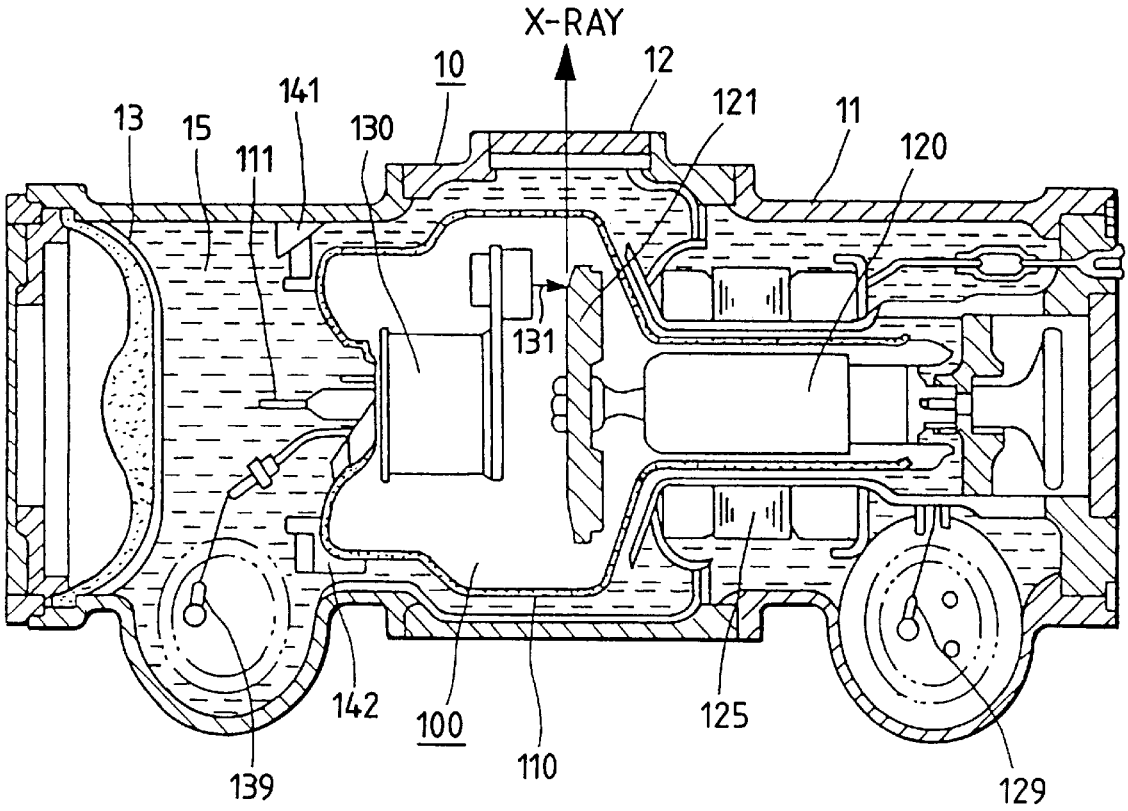
FIG. 10 is a cross-sectional view showing the construction of an X-ray tube having an X-ray target in accordance with the present invention.

FIG. 10 is a schematic cross-sectional view showing an embodiment of an X-ray tube having an X-ray target manufactured through a method in accordance with the present invention.

An X-ray tube 10 contains an X-ray bulb 100 inside an enclosing container 11. A coolant 15 is filled around the X-ray bulb globe 100 in the enclosing container. The enclosing container 11 has an X-ray radiating window 12. The X-ray radiating window 12 preferably has a lead slit constructed, for example, by attaching lead plate onto the outer surface or onto the inner surface of a glass plate except for a portion through which an X-ray is emitted. It is also preferable that an X-ray shielding member, for example, a lead plate is attached onto the inner surface of the closing container in addition to the X-ray radiating window.

The X-ray tube generates an abundance of heat as well as radiation of X-ray. In order to forcibly cool the generated heat, the coolant 15 is filled inside the closing container and recirculated. The coolant filled is preferably a liquid, for example, an insulating oil.

The X-ray bulb 100 has a rotating anode 120 and a cathode 130 in a vacuum outer enclosure 110. The vacuum outer enclosure 110 is made of glass or a complex material of metal and glass. The rotating anode 120 has an X-ray target 121 and a rotating mechanism for the X-ray target. The rotating mechanism for X-ray target has a motor rotor. A motor stator 125 is provided in a position outside the X-ray tube facing the rotor.

The cathode 130 has a filament for emitting an electron beam, and the emitted electron beam 131 is irradiated onto the X-ray target 121, and the emitted X-ray is released through the X-ray radiating window 12 of the closing container 11. The reference character 129 indicates an anode terminal, and the reference character 139 indicates a cathode terminal. The reference characters 141, 142 indicate parts for containing and fixing the X-ray bulb 100 inside the closing container 11. The reference character 111 indicates a vacuum sealing portion for evacuating the inside of the vacuum outer enclosure 110 and its end is finally sealed.

In FIG. 10, a rubber cap 13 is placed on the top end of the closing container 11. The rubber cap is provided for cope with the volume change of the insulating oil due to temperature rise of the X-ray bulb and the insulating oil by operation of the X-ray bulb. The rubber cap 13 prevent the coolant from flowing out due to pressure rise by utilizing expansion and contraction action of rubber.

The X-ray target in accordance with the present invention is suitable for using as a rotating anode in the X-ray tube having the construction shown in FIG. 10. Further, the X-ray target in accordance with the present invention is suitable for a small focus point and high bright X-ray bulb since it can withstand a large heat load.

Figure 11:
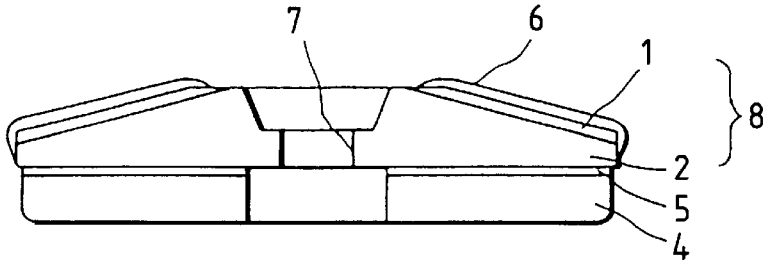
FIG. 11 is a cross-sectional view showing the construction of an embodiment of an X-ray target in accordance with the present invention.
Figure 12:
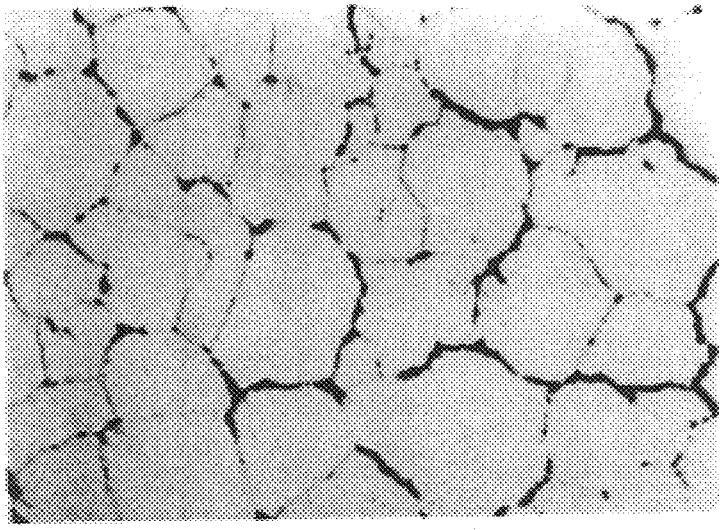
FIG. 12 is a photograph showing the surface appearance of an X-ray target in accordance with the present invention after an actual load test.
Figure 13:
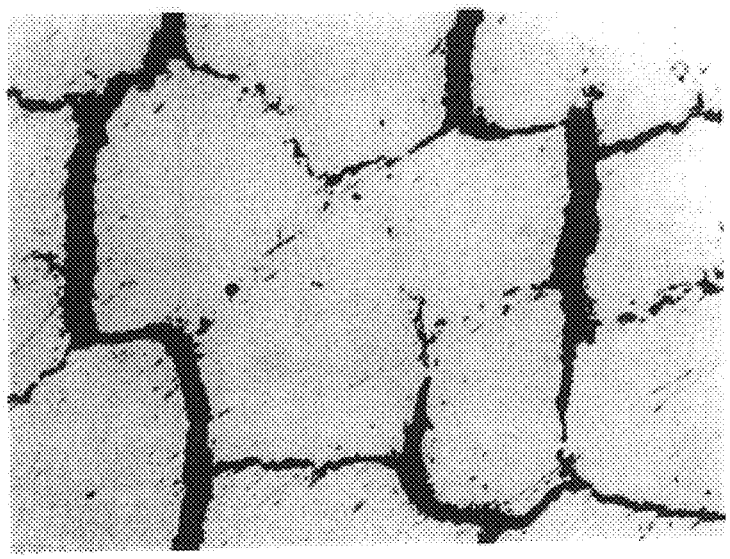
FIG. 13 is a photograph showing the surface appearance of a conventional X-ray target after an actual load test.

An X-ray target having a cross-sectional construction shown in FIG. 11 is employed as an anode target of a X-ray tube as described above. A center hole 7 is a hole for introducing a rotating shaft (not shown) made of molybdenum, and the X-ray target and the rotating shaft are fastened by a nut (not shown) or the like made of molybdenum. Further, a sloped portion for extracting X-ray is provided on the circular periphery of the X-ray target. The base plate has a construction of sintered tungsten-rhenium/molybdenum/graphite formed by bonding graphite 4 onto the electron non-irradiated surface side of the metal target 8 using a high melting point metal solder 5, and an X-ray generating metal of a fine structure tungsten-rhenium alloy 6 is coated on a sintered tungsten-rhenium alloy 1 having a rough crystal diameter to be used as an electron irradiating surface of the 5 inch diameter base plate through chemical vapor deposition method. The chemical vapor deposition is performed by heating the base plate at 450° C. in a hydrogen gas environment, and then introducing a mixed gas containing $WF_6$ and $ReF_6$ on the base plate. The base plate except the electron irradiating surface is masked with a graphite mask and the base plate is rotated with nearly 10 rpm during performing vapor deposition in order to uniformly coating the circular periphery of the base plate. The prototype X-ray target is performed with vacuum heat treatment at 1400° C. for 1 hour. The grain diameter of the fine structure tungsten-rhenium alloy at that time is 0.9 to 4.5 $\mu$m. Then, the target is assembled into a rotating anode and vacuum-sealed in an X-ray tube having a structure shown in FIG. 10. An actual load test was conducted using the above X-ray tube. After generating 50000 shots of X-ray under condition of tube voltage of 120 kV and tube current of 400 mA, change in the X-ray generating amount was investigated. The X-ray generating amount decreased compared to in the initial stage since the surface of the X-ray target was roughed due to irradiation of electron beam. The decreasing ratio of X-ray generating amount of the X-ray target coated with the fine structure tungsten-rhenium alloy in accordance with the present invention was approximately 5%. The decreasing ratio of X-ray generating amount of the conventional X-ray target not coated with the fine structure tungsten-rhenium alloy was approximately 15% compared to the initial value. The X-ray tube in accordance with the present invention was small in decreasing amount of X-ray generation and the high load resistibility was obtained. The surface of the X-ray target after actual load test was polished and heat cracks were observed. FIG. 12 is a photograph showing heat cracks in the X-ray target in accordance with the present invention, and FIG. 13 is a photograph showing heat cracks in the conventional X-ray target. The heat cracks in the X-ray target in accordance with the present invention are very fine. Length of 1 cm in FIG. 12 and FIG. 13 corresponds to 100 $\mu$m.

(Embodiment 2)

Figure 14:
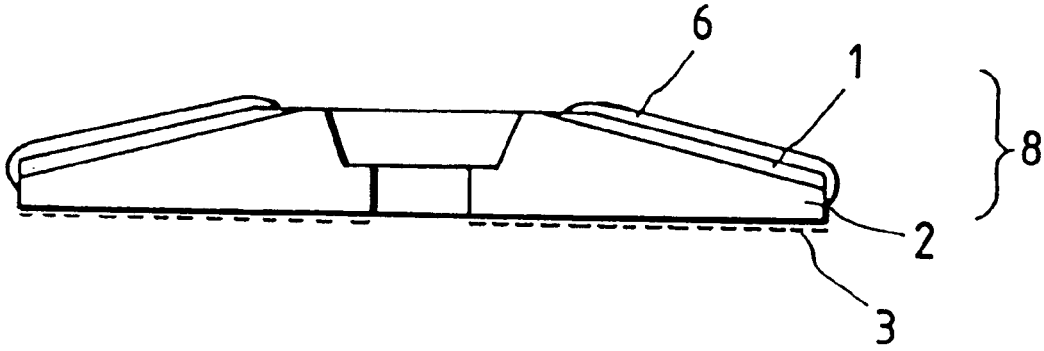
FIG. 14 is a cross-sectional view showing the construction of another embodiment of an X-ray target in accordance with the present invention.

FIG. 14 is a cross-sectional view showing the construction of another embodiment of an X-ray target in accordance with the present invention. The X-ray target is a metal target in which a sintered tungsten-rhenium alloy 1 having a coarse crystal grain diameter is laminated onto a molybdenum base plate 2. The base plate has a mixed oxide coating layer 3 containing titanium, zirconium, aluminum and so on formed onto the electron non-irradiating surface through a melt spray method to increase its thermal radiation. The base plate is coated with a fine tungsten-rhenium alloy through the chemical vapor deposition method as the same manner as in Embodiment 1. Then the mixed oxide coating layer 3 containing titanium, zirconium, aluminum and so on is formed onto the electron non-irradiating surface through a melt spray method. The target is performed with vacuum heat treatment and is vacuum sealed in an X-ray tube as the same as in Embodiment 1. An actual load test was conducted using the above X-ray tube. As the result, the same performance as in Embodiment 1 was obtained.

(Embodiment 3)

A fine structure tungsten-rhenium alloy is coated onto the same base plate as that in Embodiment 1 through the chemical vapor deposition method under the same condition as in Embodiment 1. The X-ray target is performed with vacuum heat treatment at 2000° C. for 1 hour. The grain diameter of the fine structure tungsten-rhenium alloy at that time is 2 to 8 $\mu$m. An actual load test was conducted using the above X-ray tube. As the result, it was confirmed that the X-ray target had an excellent load resistivity.

(Embodiment 4)

Figure 15:
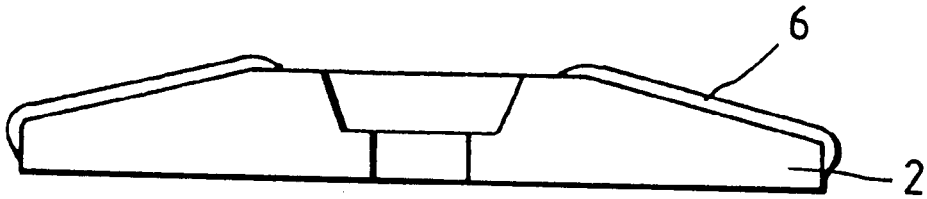
FIG. 15 is a cross-sectional view showing the construction of another embodiment of an X-ray target in accordance with the present invention.

FIG. 15 is a cross-sectional view showing the construction of another embodiment of an X-ray target in accordance with the present invention. A fine structure tungsten-rhenium alloy 6 is coated onto the electron non-irradiating surface of a molybdenum base plate 2 through the chemical vapor deposition method as the same manner as in Embodiment 1. The X-ray target is performed with the same vacuum heat treatment as in Embodiment 1. An actual load test was conducted using the above X-ray tube. As the result, it was confirmed that the X-ray target had an excellent load resistivity.

(Embodiment 5)

Figure 16:
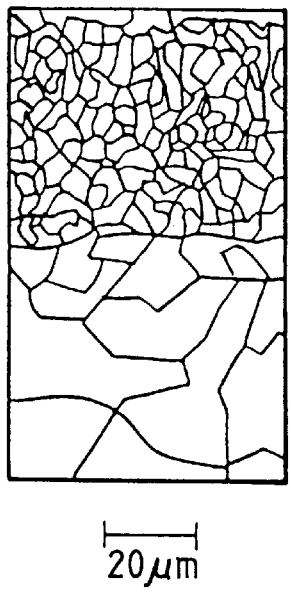
FIG. 16 is a cross-sectional view showing crystal structure of an X-ray target in accordance with the present invention after a heating test.

Heat resistance of a target in accordance with the present invention was studied by a heating test. The target was manufactured in the same manner as in Embodiment 1. A sintered tungsten-rhenium alloy having a coarse crystal grain diameter was laminated onto a molybdenum base plate, and above it a fine structure tungsten-rhenium alloy was coated through the chemical vapor deposition method, and then vacuum heat treatment was performed. From the result of the heating test using the target, coarsening due to crystal growth of the fine structure tungsten-rhenium alloy did not observed even in the very high heating temperature of 2000° C. FIG. 16 is a schematic cross-sectional view showing the crystal structure. It can be understood from FIG. 16 that the chemical vapor deposited tungsten-rhenium alloy having a fine structure formed on the base plate of the sintered tungsten-rhenium alloy having a coarse structure does not show any crystal growth and maintains the fine structure after the heating test. Further, an analysis by an X-ray method was performed to analyze residual stress in the surface of the fine structure tungsten-rhenium alloy formed through the chemical vapor deposition method on the sintered tungsten-rhenium alloy base plate after the heating test. The result showed that a compressed stress existed at any temperature and accordingly there was a stress field in which occurrence of crack due to heat load was suppressed.

(Embodiment 6)

A mixed powder of tungsten powder and rhenium powder is mixed by a ball mixer, and tungsten powder is additionally added to the mixed powder and the mixture is mixed using a V-type mixer for one hour. Paraffin is added to the mixed powder as a binder and the mixed powder is dried by heating it in a vacuum environment. The dried powder is sifted through a sieve to be classified. The classified powder is filled in a stamping die having diameter of 100 mm, and molybdenum powder is filled above the filled powder and then the powders are pressed with pressure of 300 MPa to form a pressed powder body. The paraffin in the pressed powder body is burned by heating in a hydrogen flow and the pressed powder body is sintered to form a sintered body. The sintered body obtained in such a manner is forged, cut and shaped to form a metal base plate for an X-ray target. A film is formed on the electron irradiating surface of the metal base plate obtained in such a manner through the chemical vapor deposition method.

The film forming is performed by heating the metal base plate at 450° C. in a hydrogen gas environment, then introducing a mixed gas containing $WF_6$ onto the base plate. The base plate except the electron irradiating surface is masked with a graphite mask and the base plate is rotated with nearly 10 rpm during performing vapor deposition in order to uniformly coating the circular periphery of the base plate. The chemical vapor deposition is performed by controlling chemical vapor deposition time so that film thickness of the tungsten thin film becomes approximately 20$\mu$m. Then, a mixed gas added $ReF_6$ gas to $WF_6$ gas is introduced onto the base pale to form a tungsten-rhenium thin film. The film thickness is approximately 100 $\mu$m. The X-ray target manufactured in such a manner is performed with vacuum heat treatment at 1400° C. for 1 hour.

The grain diameter of the tungsten-rhenium alloy at that time is 0.9 to 4.5 $\mu$m. Then, the target is assembled into a rotating anode and vacuum-sealed in an X-ray tube having a structure shown in FIG. 10.

(Embodiment 7)

A film is formed onto the electron irradiating surface of the metal base plate manufactured in Embodiment 6 through the chemical vapor deposition method. The film forming is performed by heating the metal base plate at 450° C. in a hydrogen gas environment, then introducing a mixed gas containing $WF_6$ onto the base plate by controlling chemical vapor deposition time so that film thickness of the tungsten thin film becomes approximately 10 $\mu$m. The base plate except the electron irradiating surface is masked with a graphite mask and the base plate is rotated with nearly 10 rpm during performing vapor deposition in order to uniformly coating the circular periphery of the base plate as the same as in Embodiment 6. Then, a mixed gas formed by adding a small amount of $ReF_6$ gas to $WF_6$ gas is introducing onto the base plate to form a tungsten-rhenium thin film containing a small amount of rhenium. After that, gradually increasing the adding amount of the $ReF_6$ gas is gradually increased so that the rhenium content at the electron irradiating surface becomes approximately 29 wt %. The total film thickness is approximately 100 $\mu$m. The X-ray target manufactured in such a manner is performed with vacuum heat treatment at 1400° C. for 1 hour.

The grain diameter of the tungsten-rhenium alloy at that time is 0.9 to 4.5 $\mu$m. Then, the target is assembled into a rotating anode and vacuum-sealed in an X-ray tube having a structure shown in FIG. 10.

(Embodiment 8)

Figure 17:
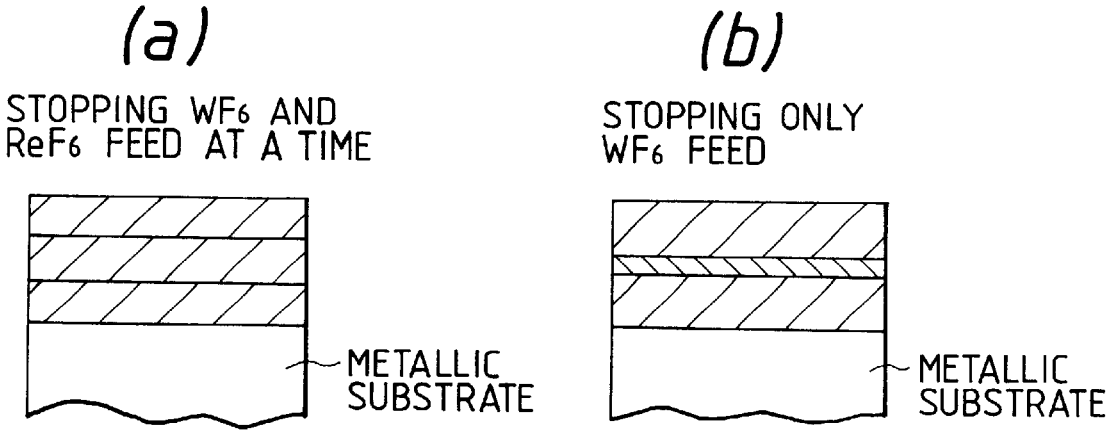
FIG. 17 is a schematic view showing the multi-layer structure of another embodiment of an X-ray target in accordance with the present invention.

A film is formed onto the electron irradiating surface of the metal base plate manufactured in Embodiment 6 through the chemical vapor deposition method. The chemical vapor deposition method is performed by introducing a mixed gas containing $WF_6$ and $ReF_6$ onto the base plate. The base plate except the electron irradiating surface is masked with a graphite mask and the base plate is rotated with nearly 10 rpm during performing vapor deposition in order to uniformly coating the circular periphery of the base plate. Two kinds of X-ray targets are manufactured, that is, one is a target manufactured by stopping introducing both of the $WF_6$ gas and the $ReF_6$ gas at a time in the middle of the chemical vapor deposition and the other is a target manufactured by stopping introducing only the $WF_6$ gas in the middle of the chemical vapor deposition. FIG. 17 is schematic views showing the multi-layer structures. FIG. 17 (*a*) shows the multi-layer structure formed by stopping introducing both of the $WF_6$ gas and the $ReF_6$ gas at a time in the middle of the chemical vapor deposition, and FIG. 17(*b*) shows the multi-layer structure formed by stopping introducing only the $WF_6$ gas in the middle of the chemical vapor deposition. Since crystal growth is stopped for a while by stopping of introduction of gases, the x-ray generating metal layer is formed in a multi-layer structure having a layer boundary. In the X-ray generating metal layer having such a structure, a crack once produced on the surface does not reach the metal base plate immediately. The reason is that progress of the crack is clinched. Thereby, there is very small possibility that a crack reaches the metal base plate immediately to cause peeling of the X-ray generating metal layer. The total film thickness of the X-ray generating metal layer manufactured in such a manner is approximately 100 $\mu$m. The X-ray target manufactured in such a manner is performed with vacuum heat treatment at 1400° C. for 1 hour. The grain diameter of the tungsten-rhenium alloy at that time is 0.9 to 4.5 $\mu$m. Then, the target is assembled into a rotating anode and vacuum-sealed in an X-ray tube having a structure shown in FIG. 10.

The X-ray target described above in accordance with the present invention has a high heat resistance since the electron irradiating surface is coated by the fine structure tungsten-rhenium alloy. Therefore, the X-ray tube incorporating the X-ray target in accordance with the present invention can provide a highly bright medical inspection image of CT apparatus since the X-ray tube can withstand a small focus point and a high load.

What is claimed is:

1. An X-ray tube comprising an anode target, the anode targe including:

a metallic base body; and an X-ray generating metallic layer, formed on a surface of the metallic base body, that generates X-rays upon irradiation with an electron beam;

wherein the X-ray generating metallic layer includes a W-Re (tungsten-rhenium) alloy layer having a grain size of 0.9 $\mu$m to 10 $\mu$m and a thickness of 200 $\mu$m or less in at least a surface region of the X-ray generating metallic layer that is to be irradiated with the electron beam.

2. An X-ray tube according to claim 1, wherein a W (tungsten) content in a portion of the W–Re (tungsten-rhenium) alloy layer that is in contact with the metallic base body is higher than a W (tungsten) content in another portion of the W–Re (tungsten-rhenium) alloy layer that is to be irradiated with the electron beam.

3. An X-ray tube according to claim 2, wherein the metallic base body is any one of a base body including a Mo (molybdenum) base plate, a base body including a Mo (molybdenum) base plate and a sintered W–Re (tungsten-rhenium) alloy layer formed on a surface of the Mo (molybdenum) base plate to which the electron beam is to be irradiated, and a base body including a Mo (molybdenum) base plate, a sintered W–Re (tungsten-rhenium) alloy layer formed on a surface of the Mo (molybdenum) base plate to which the electron beam is to be irradiated, and graphite bonded to a surface of the Mo (molybdenum) base plate to which the electron beam is not to be irradiated.

4. An X-ray tube according to claim 1, wherein the metallic base body is any one of a base body including a Mo (molybdenum) base plate, a base body including a Mo (molybdemun) base plate and a sintered W–Re (tungsten-rhenium) alloy layer formed on a surface of the Mo (molybdenum) base plate to which the electron beam is to be irradiated, and a base body including a Mo (molybdenum) base plate, a sintered W–Re (tungsten-rhenium) alloy layer formed on a surface of the Mo (molybdenum) base plate to which the electron beam is to be irradiated, and graphite bonded to a surface of the Mo (molybdenum) base plate to which the electron beam is not to be irradiated.

5. An X-ray tube according to claim 1, wherein the W–Re (tungsten-rhenium) alloy layer has a grain size of 0.9 $\mu$m to 8 $\mu$m and a thickness of 200 $\mu$m or less in at least the surface region of the X-ray generating metallic layer that is to be irradiated with the electron beam.

6. An X-ray tube according to claim 1, wherein the W–Re (tungsten-rhenium) alloy layer has a grain size of 0.9 $\mu$m to 4.5 $\mu$m and a thickness of 200 $\mu$m or less in at least the surface region of the X-ray generating metallic layer that is to be irradiated with the electron beam.

7. A method of manufacturing an X-ray tube including an anode target, the anode target including a metallic base body, and an X-ray generating metallic layer, formed on a surface of the metallic base body, that generates X-rays upon irradiation with an electron beam, the method comprising the process of maintaining the metallic base body at a temperature in a range of 250° C. to 600° C. to form the X-ray generating metallic layer on the surface of the metallic base body with a thickness of 200 $\mu$m or less composed of particles having a grain size from 0.9 $\mu$m to 10 $\mu$m using a CVD method that reduces a gas containing tungsten halide with hydrogen gas followed by heat treatment at a temperature in a range of 1000° C. to 2000° C.

8. A method according to claim 7, wherein the particles have a grain size of 0.9 $\mu$m to 8 $\mu$m.

9. A method according to claim 7, wherein the particles have a grain size of 0.9 $\mu$m to 4.5 $\mu$m.

10. An X-ray tube comprising an anode target, the anode targe including:

a metallic base body; and an X-ray generating metallic layer, formed on a surface of the metallic base body, that generates X-rays upon irradiation with an electron beam;

wherein the X-ray generating metallic layer includes a W-Re (tungsten-rhenium) alloy layer having a grain size of 0.9 $\mu$m to 10 $\mu$m in at least a surface region of the X-ray generating metallic layer that is to be irradiated with the electron beam.

11. An X-ray tube according to claim 10, wherein a W (tungsten) content in a portion of the W–Re (tungsten-rhenium) alloy layer that is in contact with the metallic base body is higher than a W (tungsten) content in another portion of the W–Re (tungsten-rhenium) alloy layer that is to be irradiated with the electron beam.

12. An X-ray tube according to claim 11, wherein the metallic base body is any one of a base body including a Mo (molybdenum) base plate, a base body including a Mo (molybdenum) base plate and a sintered W–Re (tungsten-rhenium) alloy layer formed on a surface of the Mo (molybdenum) base plate to which the electron beam is to be irradiated, and a base body including a Mo (molybdenum) base plate, a sintered W–Re (tungsten-rhenium) alloy layer formed on a surface of the Mo (molybdenum) base plate to which the electron beam is to be irradiated, and graphite bonded to a surface of the Mo (molybdenum) base plate to which the electron beam is not to be irradiated.

13. An X-ray tube according to claim 10, wherein the metallic base body is any one of a base body including a Mo (molybdenum) base plate, a base body including a Mo (molybdemun) base plate and a sintered W–Re (tungsten-rhenium) alloy layer formed on a surface of the Mo (molybdenum) base plate to which the electron beam is to be irradiated, and a base body including a Mo (molybdenum) base plate, a sintered W–Re (tungsten-rhenium) alloy layer formed on a surface of the Mo (molybdenum) base plate to which the electron beam is to be irradiated, and graphite bonded to a surface of the Mo (molybdenum) base plate to which the electron beam is not to be irradiated.

14. An X-ray tube according to claim 10, wherein the W–Re (tungsten-rhenium) alloy layer has a grain size of 0.9 $\mu$m to 8 $\mu$m in at least the surface region of the X-ray generating metallic layer that is to be irradiated with the electron beam.

15. An X-ray tube according to claim 10, wherein the W–Re (tungsten-rhenium) alloy layer has a grain size of 0.9 $\mu$m to 4.5 $\mu$m in at least the surface region of the X-ray generating metallic layer that is to be irradiated with the electron beam.

16. A method of manufacturing an X-ray tube including an anode target, the anode target including a metallic base body, and an X-ray generating metallic layer, formed on a surface of the metallic base body, that generates X-rays upon irradiation with an electron beam, the method comprising the process of maintaining the metallic base body at a temperature in a range of 250° C. to 600° C. to form the X-ray generating metallic layer on the surface of the metallic base body composed of particles having a grain size from 0.9 $\mu$m to 10 $\mu$m using a CVD method that reduces a gas containing tungsten halide with hydrogen gas followed by heat treatment at a temperature in a range of 1000° C. to 2000° C.

17. A method according to claim 16, wherein the particles have a grain size of 0.9 $\mu$m to 8 $\mu$m.

18. A method according to claim 16, wherein the particles have a grain size of 0.9 $\mu$m to 4.5 $\mu$m.

* * * * *